US006786147B2

(12) United States Patent
Shiba et al.

(10) Patent No.: US 6,786,147 B2
(45) Date of Patent: Sep. 7, 2004

(54) THREE-PART PLATE CYLINDER WITH LATERAL AND CIRCUMFERENTIAL ADJUSTMENTS FOR REGISTRATION

(75) Inventors: Noriyuki Shiba, Tokyo (JP); Yuko Tomita, Tokyo (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 46 days.

(21) Appl. No.: 10/254,552

(22) Filed: Sep. 26, 2002

(65) Prior Publication Data

US 2003/0061955 A1 Apr. 3, 2003

(30) Foreign Application Priority Data

Oct. 1, 2001 (JP) ..... P2001-305394

(51) Int. Cl.[7] ..... B41F 5/00; B41F 13/24; B41F 13/10

(52) U.S. Cl. ..... 101/216; 101/248; 101/475; 101/375; 101/382.1; 101/415.1; 492/18; 492/39

(58) Field of Search ..... 101/248, 216, 101/475, 375, 382.1, 425.1; 492/18, 39

(56) References Cited

U.S. PATENT DOCUMENTS 4,207,815 A 6/1980 Watanabe
4,596,186 A 6/1986 Shimizu
4,782,752 A * 11/1988 Etchell ..... 101/248
5,331,890 A 7/1994 Miyoshi et al.
5,535,675 A * 7/1996 Gentle ..... 101/248
5,651,314 A * 7/1997 Gentle ..... 101/248
6,129,015 A * 10/2000 Dewey ..... 101/211
6,374,731 B1 * 4/2002 Walczak et al. ..... 101/142

FOREIGN PATENT DOCUMENTS

JP 59-031467 8/1984
JP 03-140245 6/1991
JP 06-011769 3/1994
JP 06-038681 10/1994
JP 09-141826 6/1997

OTHER PUBLICATIONS

European Search Report, Feb. 2004.

* cited by examiner

*Primary Examiner*—Andrew H. Hirshfeld
*Assistant Examiner*—Marvin P. Crenshaw
(74) *Attorney, Agent, or Firm*—Rader, Fishman & Grauer PLLC

(57) ABSTRACT

A web-fed, multicolor, offset printing press having a plurality of printing units for printing different-color images on a continuous web of paper. Each printing unit includes a three-part plate cylinder rotatably supported between a pair of confronting framing walls. The plate cylinder is split into three parts which each have two newspaper pages width. The three parts of the plate cylinder are each capable of adjustable displacement both laterally and circumferentially of the plate cylinder for registration. Lateral and circumferential adjustments for the three parts of the plate cylinder are all mounted outside the framing walls.

11 Claims, 5 Drawing Sheets

THREE-PART PLATE CYLINDER WITH LATERAL AND CIRCUMFERENTIAL ADJUSTMENTS FOR REGISTRATION

BACKGROUND OF THE INVENTION

1. Field of the Invention

This invention relates to printing presses, and more particularly to a web-fed, multicolor printing press having a plurality of printing units for printing different color images on a continuous web of paper or like printable material. Still more particularly, the invention deals with such a press wherein each plate cylinder is split into three parts, each with a lateral dimension equal to two newspaper pages, for independently carrying as many printing plates thereby concurrently to print images in transverse juxtaposition on the web. Even more particularly, the invention concerns improvements in or relating to means in such a multicolor printing press for fine, independent readjustment of both lateral and circumferential positions of the three parts of each plate cylinder with a view to exact registration of different color images on the web.

2. Description of the Prior Art

It has been known and practiced extensively to split a plate cylinder into two or more parts that are capable of both lateral and circumferential displacement relative to each other. An example is the multicolor newspaper printing press in which each plate cylinder is split into a pair of halves each having two-newspaper-page width. Japanese Patent Publication No. 59-31467 and Japanese Utility Model Publication Nos. 6-11769 and 6-38681 are hereby cited as teaching such split plate cylinders.

Japanese Patent Publication No. 59-31467 and Japanese Utility Model Publication No. 6-11769 both suggest a plate cylinder comprised of a first cylinder part having a reduced diameter core extending coaxially therefrom, and a second cylinder part of tubular shape slidably fitted over the core and having an outside diameter equal to the diameter of the first cylinder part. Adjustments are provided for independently varying the lateral and circumferential positions of the two plate cylinder parts. According to Japanese Patent Publication No. 59-31467, the lateral and circumferential adjustments for the two cylinder parts are both disposed outside the pair of confronting framing walls between which the split plate cylinder is supported. Japanese Utility Model Publication No. 6-11769 differs in providing the lateral and circumferential adjustments for one plate cylinder part on the outside of one framing wall, and those for the other plate cylinder part on the inside of the same framing wall.

Japanese Utility Model Publication No. 6-38681 teaches a plate cylinder comprised of a pair of halves of tubular shape, both slidably mounted on a core of cylindrical shape. The lateral and circumferential adjustments for one plate cylinder half are provided on the outside of one framing wall, and those for the other plate cylinder half on the outside of the other framing wall. Driving torque is first transmitted to the core and thence to the pair of tubular halves, in order that the three constituent parts may be jointly rotatable, and that the pair of tubular halves may be independently adjustable circumferentially.

The three foregoing citations are alike in teaching two-part plate cylinders but silent on the division of a plate cylinder into three. Japanese Utility Model Publication No. 6-11769 in particular has an additional problem arising from the placement of all the lateral and circumferential adjustments for the two plate cylinder parts in the neighborhood of one of the pair of framing walls. As one lateral, and one circumferential, adjustment are positioned on the inside of that one framing wall, the distance between the two framing walls must of necessity be much longer than in the absence of such adjustments. The long span between the walls has made it necessary to provide a plate cylinder having a pair of correspondingly elongate trunnions, which of course are much slender than the plate cylinder itself. The plate cylinder has therefore been easy to sag under its own weight, with consequent difficulties in lateral and circumferential displacement of the two plate cylinder parts due to a rise in frictional resistance.

It has also been known to split a plate cylinder into four parts, each one newspaper page wide, as disclosed for example in Japanese Patent No. 2,726,716. The four-part plate cylinder comprises a solid cylinder part which has one or two newspaper pages width and which has rod-like cores of smaller diameter extending coaxially therefrom, and hollow cylinder parts which are each one or two newspaper pages wide and which are slidably mounted to the cores. Lateral and circumferential adjustments are provided for each of the solid and hollow plate cylinder parts. The adjustments for the solid plate cylinder part lie on the outside of one of the pair of framing walls, and those for each hollow plate cylinder part on the outside of that one of the pair of framing walls which is closer to that hollow plate cylinder part. Where two lateral, and two circumferential, adjustments are provided, the lateral adjustment for the plate cylinder part located centrally of the plate cylinder is mounted to the bearing sleeve supporting the plate cylinder, and the circumferential adjustment for that plate cylinder part is mounted to the blanket cylinder adjoining the plate cylinder in question.

An objection to this prior art four-part plate cylinder is the extreme complexity of the lateral and circumferential adjustments. Another serious disadvantage is that the lateral displacement of the solid plate cylinder part causes simultaneous displacement of a helical gear constituting a part of the drive linkage to that plate cylinder part, resulting in simultaneous angular displacement of the plate cylinder part by reason of the twisted gear teeth. Lateral displacement has thus been not independent of circumferential displacement.

Attempts have been made in recent years to make plate cylinders greater in diameter or length with a view to higher production, aside from an increase in printing speed. Japanese Unexamined Patent Publication No. 9-141826 represents an example of such conventional attempts at longer plate cylinders. It is not disclosed, however, to divide such a long plate cylinder into several parts that are independently displaceable both laterally and circumferentially.

SUMMARY OF THE INVENTION

The present invention has it as an object to provide a three-part plate cylinder for use in a web-fed, multicolor offset printing press or the like, so made that the three plate cylinder parts are independently adjustable both laterally and circumferentially for registration.

Another object of the invention is to make the three-part plate cylinder itself and the lateral and circumferential adjustments therefor as simple, compact and inexpensive as feasible in construction.

Still another object of the invention is to arrange the lateral and circumferential arrangements in such a manner that the span between the pair of confronting framing walls is kept at a minimum in order to prevent the three-part plate cylinder from sagging under its own weight.

Briefly, the present invention concerns, in a web-fed printing press having a series of printing units for printing images on a continuous web of paper or like material, a three-part plate cylinder apparatus included in each printing unit. The three-part plate cylinder apparatus comprises a plate cylinder which is rotatably supported between a pair of spaced-apart framing walls or like means and which is split into three. The three parts of the plate cylinder are capable of displacement both laterally and circumferentially independently of one another for registration. Drive means are coupled to the three parts of the plate cylinder for jointly driving them during printing. Also included are lateral adjustment means which are mounted outside the framing means and which are coupled to the three parts of the plate cylinder for causing lateral displacement of each part independently of the other parts, and circumferential adjustment means which are mounted outside the framing means and which are coupled to the three parts of the plate cylinder for causing circumferential displacement of each part independently of the other parts.

The three parts of the plate cylinder consist of a center part having a first and a second trunnion coaxially extending in opposite directions therefrom through the pair of framing means, a first end part having a first hollow shaft slidably fitted over the first trunnion of the plate cylinder center part, and a second end part having a second hollow shaft slidably fitted over the second trunnion of the plate cylinder center part. The three parts of the plate cylinder are jointly drivable as by gears coupled to either of the trunnions of the center part and to the hollow shafts of the two end parts. The lateral and the circumferential adjustment means for the three parts of the plate cylinder are also coupled to the trunnions of the center part and to the hollow shafts of the two end parts, all on the outsides of the framing walls. The lateral and circumferential adjustment means for the center part of the three parts of the plate cylinder are mounted outside in separate frame means, respectively.

When the images printed by the different printing units of the press are found to be out of register, any of the center part and two end parts may be repositioned in either or both of the lateral and circumferential directions as required for registration. Such positional readjustment is possible during the progress of printing. Each plate cylinder part is readjustable totally independently of the others, and the displacement of each plate cylinder part in either of the lateral and circumferential directions does not affect its position in the other direction.

Since the lateral and the circumferential adjustments for the three parts of the plate cylinder are all mounted outside the framing walls as above, these walls can be spaced from each other a distance just needed to accommodate the plate cylinder itself therebetween. The sagging of the plate cylinder under its own weight can thus be reduced to a minimum, assuring stable rotation for printing and smooth lateral and circumferential displacement of the plate cylinder parts for registration.

In the preferred embodiments of the invention to be disclosed subsequently, each plate cylinder part is capable of carrying a printing plate that has two newspaper pages width. The plate cylinder as a whole is capable of concurrently printing six newspaper pages. For production of 48-page newspapers, therefore, the invention requires only four double-side printing units, compared to six such units heretofore required by machines employing four-newspaper-page plate cylinders. The reduction of the printing units is tantamount to that of the distance the web of paper is required to travel from the infeed to the folding station, and, in consequence, to that of the amount of paper wasted while being threaded along the predefined path through the press. Additionally, the invention also results in a decrease (to two thirds) of the pastings required from one web to another, and of the waste of paper resulting from pasting failures.

The above and other objects, features and advantages of this invention and the manner of realizing them will become more apparent, and the invention itself will best be understood, from a study of the following description and appended claims, with reference had to the attached drawings showing the preferred embodiments of the invention.

DESCRIPTION OF THE PREFERRED EMBODIMENTS

General

Figure 1:
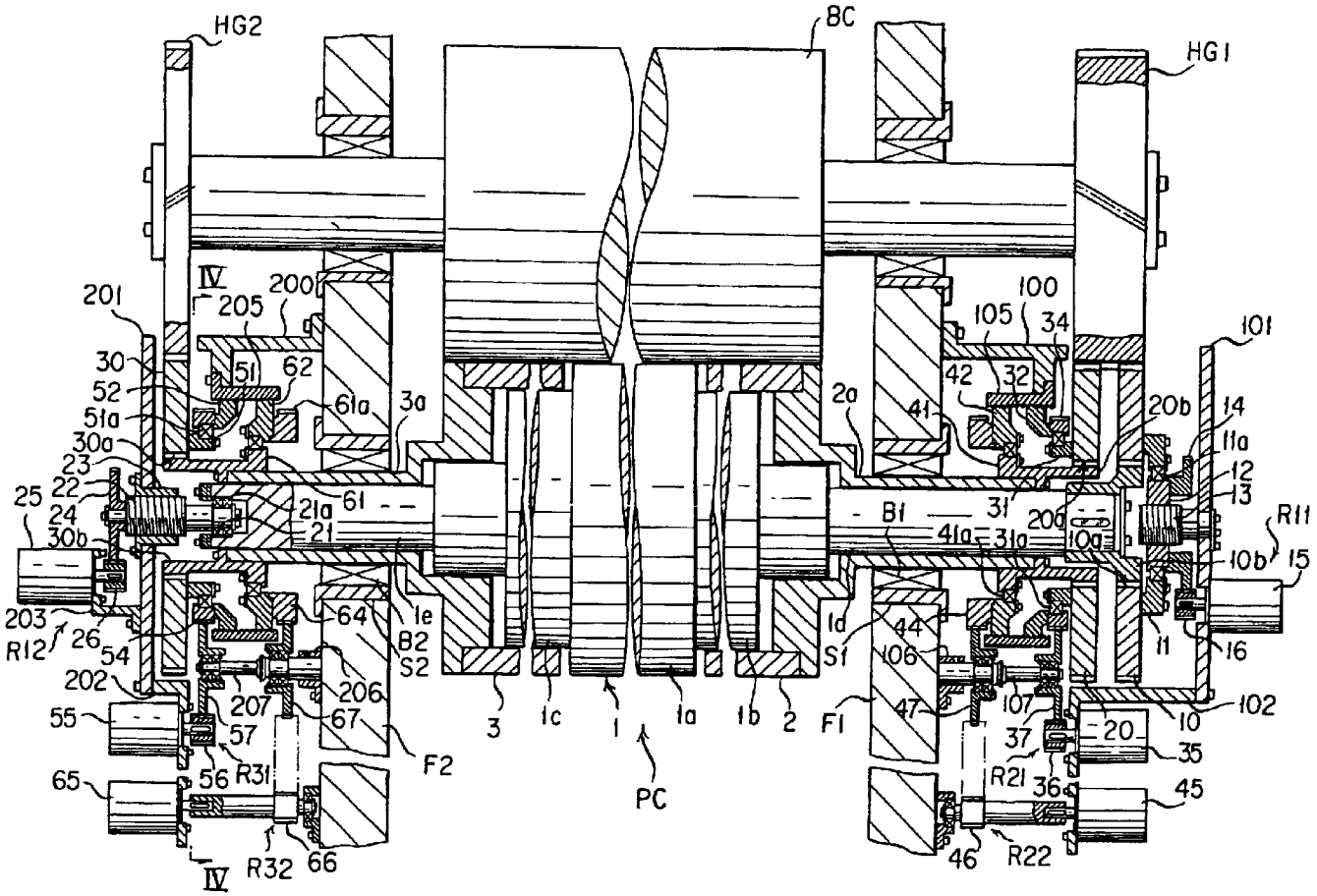
FIG. 1 is a developed, sectional view, with parts shown broken away for illustrative convenience, of a preferred form of three-part plate cylinder apparatus according to the invention, the section being taken along the line I—I in FIG. 2.

The present invention is believed to be best applicable to a web-fed, multicolor offset printing press having a series of printing units. FIG. 1 shows part of one such printing unit having a three-part plate cylinder PC according to the invention together with a blanket cylinder BC. Both cylinders PC and BC are supported parallel to each other by and between a pair of confronting framing walls $F_1$ and $F_2$. It is understood that the blanket cylinder BC is upstream of the plate cylinder PC with respect to the direction of driving-torque transmission during driving according to the usual practice in the art.

Referring more specifically to FIG. 1, the plate cylinder PC is divided into a center part 1, a first end part 2 seen to the right of the center part, and a second end part 3 seen to the left. The three plate cylinder parts 1–3 are equal in diameter and lateral dimension, capable of carrying printing plates, not shown, of the same size. Each of the plate cylinder parts 1–3 has two newspaper pages width in this particular embodiment; that is, each plate cylinder part is capable of printing two newspaper pages side-by-side laterally of the plate cylinder PC.

On the outside of the first or right-hand framing wall $F_1$, as seen in FIG. 1, there is provided a circumferential adjustment $R_{11}$ for adjustably varying the circumferential position of the plate cylinder center part 1. On the outside of the second or left-hand framing wall $F_2$, on the other hand, there is provided a lateral adjustment $R_{12}$ for adjustably varying the lateral position of the plate cylinder center part 1. A circumferential adjustment $R_{21}$ and lateral adjustment $R_{22}$ for the plate cylinder first end part 2 are both provided on the outside of the first framing wall $F_1$. A circumferential adjustment $R_{31}$ and lateral adjustment $R_{32}$ for the plate cylinder second end part 3 are both provided on the outside of the second framing wall $F_2$.

It will thus be appreciated that all the circumferential and lateral adjustments for the three plate cylinder parts 1–3 lie outside the pair of framing walls $F_1$ and $F_2$. For this reason the plate cylinder PC can be made so long that, as has been set forth above, each plate cylinder part is capable of carrying a printing plate that has two newspaper pages width.

Hereinafter in this specification the above listed plate cylinder PC, plate cylinder center part circumferential adjustment $R_{11}$, plate cylinder center part lateral adjustment $R_{12}$, plate cylinder first end part circumferential adjustment $R_{21}$, plate cylinder first end part lateral adjustment $R_{22}$, plate cylinder second end part circumferential adjustment $R_{31}$, and plate cylinder second end part lateral adjustment $R_{32}$ will be explained in more detail, in that order and under separate headings. An operational description will follow the explanation of the listed mechanisms.

Plate Cylinder

With continued reference to FIG. 1 the plate cylinder PC is divided as aforesaid into the center part 1, first or right-hand end part 2, and second or left-hand end part 3 of the same diameter and lateral dimension. The plate cylinder center part 1 is a one-piece construction of a larger diameter portion $\mathbf{1}_a$, a pair of smaller diameter portions $\mathbf{1}_b$ and $\mathbf{1}_c$ coaxially extending in opposite directions from the larger diameter portion, and a pair of even smaller diameter portions or trunnions $\mathbf{1}_d$ and $\mathbf{1}_e$ coaxially extending in opposite directions from the smaller diameter portions $\mathbf{1}_b$ and $\mathbf{1}_c$. Both tubular in shape, the plate cylinder end parts 2 and 3 are slidably sleeved respectively upon the pair of smaller diameter portions $\mathbf{1}_b$ and $\mathbf{1}_c$ of the plate cylinder center part 1 for both lateral and circumferential displacement. The larger diameter portion $\mathbf{1}_a$ of the plate cylinder center part 1 and the two plate cylinder end parts 2 and 3 are all equal in diameter and lateral dimension.

The pair of trunnions $\mathbf{1}_d$ and $\mathbf{1}_e$ of the plate cylinder center part 1 extend through the pair of framing walls $F_1$ and $F_2$ and project a considerable distance therefrom. The plate cylinder first end part 2 has a hollow shaft $\mathbf{2}_a$ extending coaxially therefrom and slidably sleeved on the plate cylinder center part first trunnion $\mathbf{1}_d$ for both axial and circumferential displacement. Itself extending through the first framing wall $F_1$, the plate cylinder first end part hollow shaft $\mathbf{2}_a$ is thereby supported via a bearing $B_1$ and sleeve $S_1$ for both axial and angular motion relative to the first framing wall. The plate cylinder second end part 3 likewise has a hollow shaft $\mathbf{3}_a$ extending coaxially therefrom and slidably sleeved on the plate cylinder center part second trunnion $\mathbf{1}_e$ for both axial and circumferential displacement. The plate cylinder second end part hollow shaft $\mathbf{3}_a$ is supported by the second framing wall $F_2$ via a bearing $B_2$ and sleeve $S_2$ for both axial and angular motion relative to the second framing wall.

Plate Cylinder Center Part Circumferential Adjustment

Projecting outwardly of the plate cylinder first end part hollow shaft $\mathbf{2}_a$ as shown in FIG. 1, the plate cylinder center part first trunnion $\mathbf{1}_d$ is coupled via a helical gear 10 to the circumferential adjustment $R_{11}$ for readjusting the angular position of the plate cylinder center part 1 about its axis. The helical gear 10 meshes with a helical gear $HG_1$ on one of the trunnions of the blanket cylinder BC in order to be driven thereby. Further the helical gear 10 is internally straight-splined at $\mathbf{10}_a$ to mesh with an externally straight-splined member $\mathbf{10}_b$ coaxially mounted fast to the projecting end of the plate cylinder center part first trunnion $\mathbf{1}_d$. Thus the helical gear 10 functions to transmit the rotation of the helical gear $HG_1$ to the plate cylinder center part first trunnion $\mathbf{1}_d$ but is free to travel axially relative to the latter.

The plate cylinder center part circumferential adjustment $R_{11}$ includes a bearing housing 11 coaxially affixed to the helical gear 10 for carrying a bearing $\mathbf{11}_a$. An internally screw-threaded ring 12 is rotatably supported by the bearing $\mathbf{11}_a$ while being constrained to joint axial travel therewith. The internally threaded ring 12 is coaxially mounted on, and threadedly engaged with, an externally screw-threaded rod 13 which is immovably fastened to the end wall 101 of an enclosure 100, which in turn is mounted fast to the first framing wall $F_1$. Coaxially mounted fast to the internally threaded ring 12, a driven gear 14 meshes with a drive pinion 16 on the output shaft of a plate cylinder center part circumferential adjustment motor 15 mounted to the enclosure end wall 101. This motor 15 is capable of bidirectional rotation by small, finely controllable increments.

Thus the bidirectional rotation of the plate cylinder center part circumferential adjustment motor 15 will be imparted to the internally threaded ring 12 via the intermeshing gears 14 and 16. Thereupon the internally threaded ring 12 will travel axially by virtue of its threaded engagement with the threaded rod 13. Being constrained to joint axial travel with the internally threaded ring 12 via the bearing housing 11 and bearing $\mathbf{11}_a$, the helical gear 10 will travel axially and, by reason of its sliding engagement with the helical gear $HG_1$ on the blanket cylinder BC, circumferentially as well.

Although the helical gear 10 will travel both axially and circumferentially as above, this axial motion will not be imparted to the plate cylinder center part first trunnion $\mathbf{1}_d$ because of the straight-spline engagement of the helical gear 10 therewith. Only the rotation of the helical gear 10 will be applied to the plate cylinder center part 1, causing the latter to be angularly displaced in either direction with its lateral position held unaltered. Incidentally, during printing, the driving torque of the helical gear $HG_1$ will be transmitted to the plate cylinder center part 1 via the helical gear 10 by virtue of the straight-spline engagement between these members 1 and 10, but not to the internally threaded ring 12 because of the interposition of the bearing $\mathbf{11}_a$ therebetween.

Plate Cylinder Center Part Lateral Adjustment

As shown also in FIG. 1, the plate cylinder center part second trunnion $\mathbf{1}_e$ projects outwardly of the plate cylinder second end part hollow shaft $\mathbf{3}_a$ and is coupled to the lateral adjustment $R_{12}$ for causing lateral displacement of the plate cylinder center part 1. The plate cylinder center part lateral adjustment $R_{12}$ includes a bearing housing 21 which supports a bearing $\mathbf{21}_a$ within a depression formed axially in the projecting end of the plate cylinder center part second trunnion $\mathbf{1}_e$. A screw-threaded rod 22 is coaxially and rotatably coupled to the plate cylinder center part second trunnion $\mathbf{1}_e$ by having one end thereof journaled in the bearing $\mathbf{21}_a$. In threaded engagement with the threaded rod 22 is an internally screw-threaded sleeve 23 which is mounted fast to the end wall 201 of an enclosure 200 on the second framing wall $F_2$. The threaded rod 22 has mounted on its other end a driven gear 24 in mesh with a drive pinion 26 on the output shaft of a bidirectional plate cylinder center part lateral adjustment motor 25. As shown also in FIG. 2, this motor 25 is bracketed at 203 to the enclosure end wall 201.

Such being the construction of the plate cylinder center part lateral adjustment $R_{12}$, the bidirectional rotation of the motor 25 will be imparted to the threaded rod 22 via the intermeshing gears 24 and 26. Thereupon the threaded rod 22 will undergo both angular and axial motion by virtue of its sliding engagement with the internally threaded sleeve 23. Since the threaded rod 22 is coupled to the plate cylinder center part second trunnion $1_e$ via the bearing 21*a*, only the axial travel of the threaded rod 22 will be transmitted to the trunnion. Thus the plate cylinder center part 1 will adjustably travel laterally in either of two opposite directions.

The first trunnion $1_d$ of the plate cylinder center part 1 will also travel axially therewith. Such axial motion will not be transmitted to the helical gear 10 because the latter is straight-splined to the plate cylinder center part first trunnion $1_d$. Consequently, the plate cylinder center part 1 will undergo no angular displacement but only travel laterally. Incidentally, during printing, the plate cylinder center part second trunnion $1_e$ will rotate as the plate cylinder center part is driven from the helical gear 10 in straight-spline engagement with the plate cylinder center part first trunnion $1_d$. This rotation of the plate cylinder center part second trunnion $1_e$ will not be transmitted to the threaded rod 22 of the plate cylinder center part lateral adjustment $R_{12}$ because of the presence of the bearing $21_a$ therebetween.

Plate Cylinder First End Part Circumferential Adjustment

The plate cylinder first or right-hand end part 2 has the hollow shaft $2_a$ slidably sleeved on the plate cylinder center part first trunnion $1_d$ and extending through the first framing wall $F_1$ for both axial and circumferential displacement relative to both first framing wall and plate cylinder center part first trunnion. Projecting outwardly of the first framing wall $F_1$, the plate cylinder first end part hollow shaft $2_a$ is coupled via a second driven helical gear 20 to the circumferential adjustment $R_{21}$ for readjusting the angular position of the plate cylinder first end part 2 about its own axis. The second driven helical gear 20 meshes with the driving helical gear $HG_1$ on one of the trunnions of the blanket cylinder BC. The second driven helical gear 20 is internally straight-splined at $20_a$ to engage an externally straight-splined member $20_b$ coaxially mounted fast to the projecting end of the plate cylinder first end part hollow shaft $2_a$. The second driven helical gear 20 functions to transmit the rotation of the driving helical gear $HG_1$ to the plate cylinder first end part hollow shaft $2_a$ but is free to travel axially relative to the latter.

Figure 3:
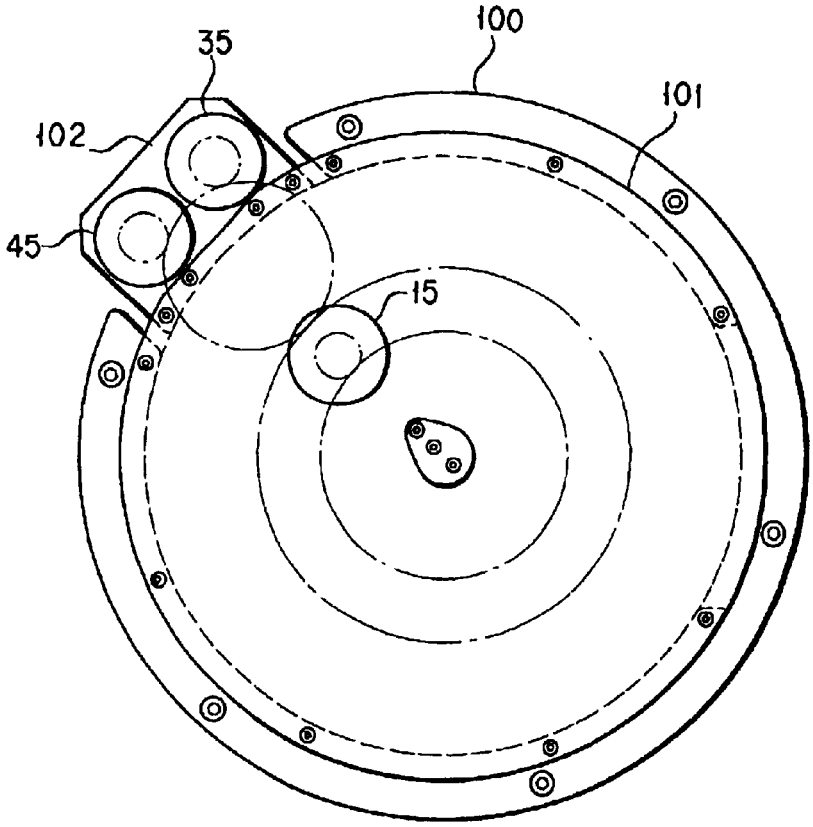
FIG. 3 is a right-hand side elevation of FIG. 1.
Figure 4:
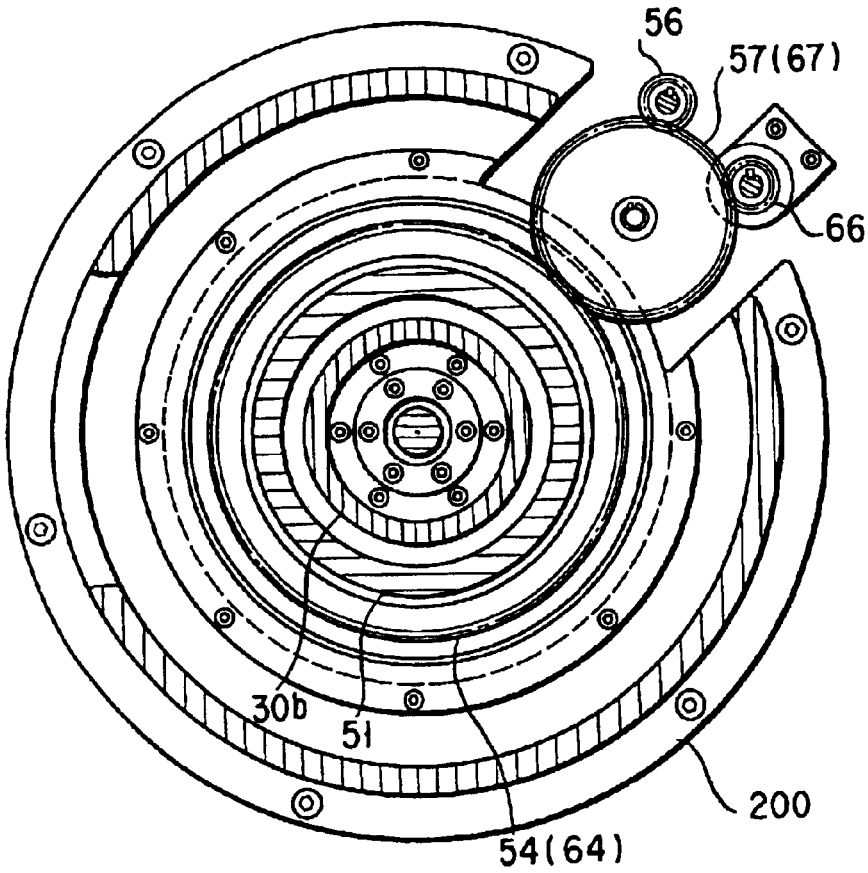
FIG. 4 is a section taken along the line IV—IV in FIG. 1.

The plate cylinder first end part circumferential adjustment $R_{21}$ includes a bearing housing 31 coaxially affixed to that surface of the second driven helical gear 20 which faces the first framing wall $F_1$, for carrying a bearing $31_a$. Rotatably supported by this bearing $31_a$ are an externally screw-threaded ring 32 and, coupled fast thereto, a driven gear 34. The externally threaded ring 32 is in mesh with an internally screw-threaded ring 105 which is mounted fast to the enclosure 100 on the first framing wall $F_1$ and which constitutes a part of both plate cylinder first end part circumferential adjustment $R_{21}$ and plate cylinder first end part lateral adjustment $R_{22}$. The driven gear 34 is in mesh with a drive pinion 36 via an intermediate gear 37. The drive pinion 36 is mounted to the output shaft of a bidirectional plate cylinder first end part circumferential adjustment motor 35 which, as shown also in FIG. 3, is bracketed at 102 to the enclosure end wall 101. The intermediate gear 37 is rotatably mounted to a shaft 107 which is cantilevered at 106 to the first framing wall $F_1$.

In the operation of the plate cylinder first end part circumferential adjustment $R_{21}$, the bidirectional rotation of the motor 35 will be imparted to the externally threaded ring 32 via the drive pinion 36, intermediate gear 37, and driven gear 34. Thereupon the externally threaded ring 32 will travel axially by virtue of its threaded engagement with the internally threaded ring 105. Being constrained to joint axial travel with the externally threaded ring 32 via the bearing housing 31 and bearing $31_a$, the second driven helical gear 20 will travel axially and, by reason of its sliding engagement with the driving helical gear $HG_1$ on the blanket cylinder BC, circumferentially as well.

Of the combined axial and circumferential displacement of the second driven helical gear 20, the axial motion will not be imparted to the plate cylinder first end part hollow shaft $2_a$ because of the straight-spline engagement of the second driven helical gear therewith. Only the angular motion of the second driven helical gear 20 will be applied to the plate cylinder first end part 2, causing the latter to be angularly displaced in either direction with its lateral position held unaltered.

Incidentally, during printing, the driving torque of the helical gear $HG_1$ will be transmitted to the plate cylinder first end part 2 via the second driven helical gear 20 by virtue of the straight-spline engagement between these members 2 and 20. The driving torque will, however, be not applied to the externally threaded ring 32 of the plate cylinder first end part circumferential adjustment $R_{21}$ because of the interposition of the bearing $31_a$ between the second driven helical gear 20 and the externally threaded ring 32.

Plate Cylinder First End Part Lateral Adjustment

The plate cylinder first end part lateral adjustment $R_{22}$ includes a bearing carrier 41 rigidly encircling the plate cylinder first end part hollow shaft $2_a$. An externally screw-threaded ring 42 is rotatably mounted on the plate cylinder first end part hollow shaft $2_a$ via a bearing $41_a$ on the bearing carrier 41. This threaded ring 42 is in mesh with the aforesaid internally threaded ring 105 which is shared by both plate cylinder first end part circumferential adjustment $R_{21}$ and lateral adjustment $R_{22}$. The externally threaded ring 42 is rigidly and concentrically attached to a driven gear 44 of annular shape. The driven gear 44 meshes with a drive pinion 46 via an intermediate gear 47. The drive pinion 46 is mounted to the output shaft of a bidirectional plate cylinder first end part lateral adjustment motor 45 which, as shown also in FIG. 3, is bracketed at 102 to the enclosure end wall 101 in side-by-side arrangement with the plate cylinder first end part circumferential adjustment motor 35. The intermediate gear 47 is rotatably mounted to the aforementioned cantilever shaft 107 on the first framing wall $F_1$.

The operation of the plate cylinder first end part lateral adjustment $R_{22}$ is such that the bidirectional rotation of the motor 45 will be imparted to the externally threaded ring 42 via the drive pinion 46, intermediate gear 47, and driven gear 44. Being in threaded engagement with the internally threaded ring 105, the externally threaded ring 42 will travel axially, causing simultaneous lateral displacement of the plate cylinder first end part 2 via the bearing $41_a$, bearing carrier 41, and plate cylinder first end part hollow shaft $2_a$.

The axial travel of the plate cylinder first end part hollow shaft $2_a$ will not affect the second driven helical gear 20 by virtue of the straight-spline engagement therebetween. The plate cylinder first end part 2 will therefore travel only laterally. The driving torque of the helical gear $HG_1$ will be applied to the plate cylinder first end part 2 via the second driven helical gear 20 in straight-spline engagement with the plate cylinder first end part hollow shaft $2_a$, but not to the threaded ring 42 because of the presence of the bearing $41_a$.

Consequently, despite the provision of the plate cylinder first end part lateral adjustment $R_{22}$, the plate cylinder first end part 2 will be driven with its lateral position unchanged.

Plate Cylinder Second End Part Circumferential Adjustment

The plate cylinder second or left-hand end part 3 has the hollow shaft $\mathbf{3}_a$ slidably sleeved on the plate cylinder center part second trunnion $\mathbf{1}_e$ and extending through the second framing wall $F_2$ for both axial and circumferential displacement relative to both second framing wall and plate cylinder center part second trunnion. Projecting outwardly of the second framing wall $F_2$, the plate cylinder second end part hollow shaft $\mathbf{3}_a$ is coupled via a third driven helical gear 30 to the circumferential adjustment $R_{31}$ for readjusting the angular position of the plate cylinder second end part 3 about its own axis. The third driven helical gear 30 meshes with the second driving helical gear $HG_2$ on the second or left-hand trunnion of the blanket cylinder BC. The third driven helical gear 30 is internally straight-splined at $\mathbf{30}_a$ to engage an externally straight-splined member $\mathbf{30}_b$ coaxially mounted fast to the projecting end of the plate cylinder second end part hollow shaft $\mathbf{3}_a$. The third driven helical gear 30 functions to transmit the rotation of the second driving helical gear $HG_2$ to the plate cylinder second end part hollow shaft $\mathbf{3}_a$ but is free to travel axially relative to the latter.

Figure 2:
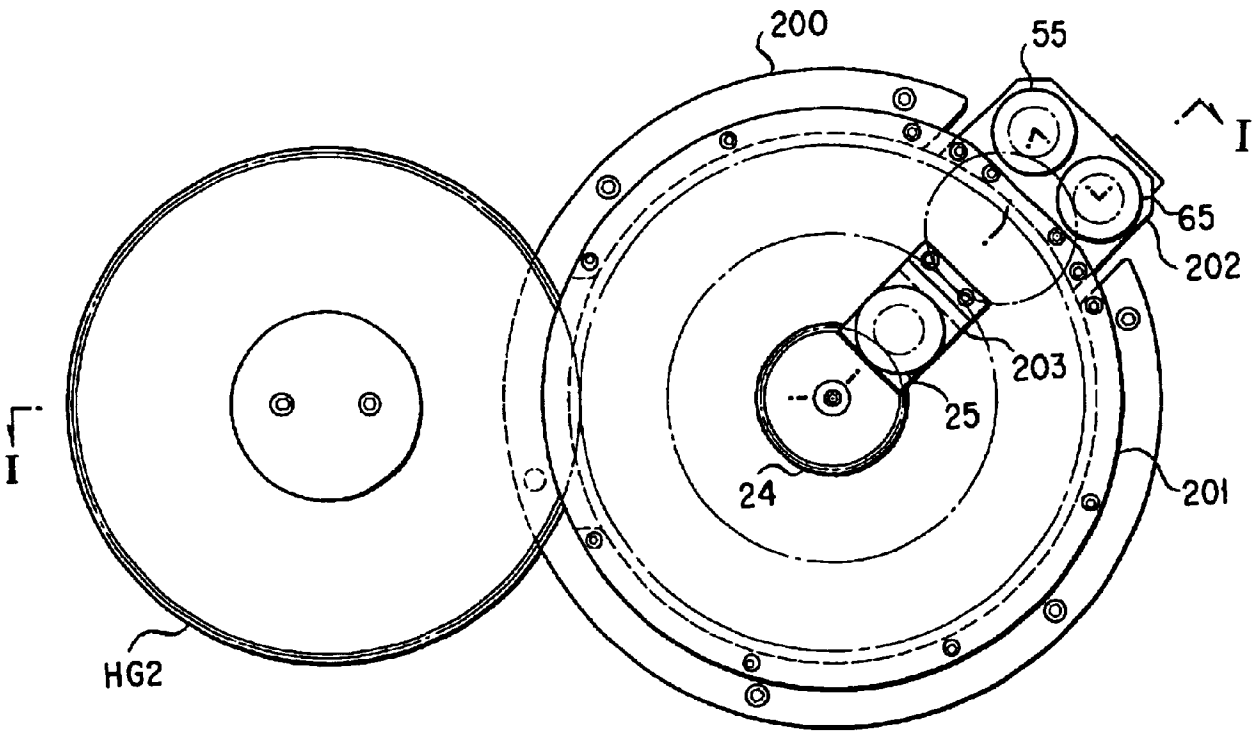
FIG. 2 is a left-hand side elevation of FIG. 1.

The plate cylinder second end part circumferential adjustment $R_{31}$ includes a bearing housing 51 coaxially affixed to that surface of the third driven helical gear 30 which faces the second framing wall $F_2$, for carrying a bearing $\mathbf{51}_a$. Rotatably supported by this bearing $\mathbf{51}_a$ are an externally screw-threaded ring 52 and, coupled fast thereto, a driven gear 54. The externally threaded ring 52 is in mesh with an internally screw-threaded ring 205 which is mounted fast to the enclosure 200 on the second framing wall $F_2$ and which constitutes a part of both plate cylinder second end part circumferential adjustment $R_{31}$ and plate cylinder second end part lateral adjustment $R_{32}$. The driven gear 54 is in mesh with a drive pinion 56 via an intermediate gear 57. The drive pinion 56 is mounted to the output shaft of a bidirectional plate cylinder second end part circumferential adjustment motor 55 which, as shown also in FIG. 2, is bracketed at 202 to the enclosure end wall 201. The intermediate gear 57 is rotatably mounted to a shaft 207 which is cantilevered at 206 to the second framing wall $F_2$.

In the operation of the plate cylinder second end part circumferential adjustment $R_{31}$, the bidirectional rotation of the motor 55 will be imparted to the externally threaded ring 52 via the drive pinion 56, intermediate gear 57, and driven gear 54. Thereupon the externally threaded ring 52 will travel axially by virtue of its threaded engagement with the internally threaded ring 205. Being constrained to joint axial travel with the externally threaded ring 52 via the bearing housing 51 and bearing $\mathbf{51}_a$, the third driven helical gear 30 will travel axially and, by reason of its sliding engagement with the second driving helical gear $HG_2$ on the blanket cylinder BC, circumferentially as well.

Of the combined axial and circumferential displacement of the third driven helical gear 30, the axial motion will not be imparted to the plate cylinder second end part hollow shaft $\mathbf{3}_a$ because of the straight-spline engagement of the third driven helical gear therewith. Only the angular motion of the third driven helical gear 30 will be applied to the plate cylinder second end part 3, causing the latter to be angularly displaced in either direction with its lateral position held unaltered.

During printing, the driving torque of the second driving helical gear $HG_2$ will be transmitted to the plate cylinder second end part 3 via the third driven helical gear 30 by virtue of the straight-spline engagement between these members 3 and 30. The externally threaded ring 52 of the plate cylinder second end part circumferential adjustment $R_{31}$ will not receive such driving torque because of the interposition of the bearing $\mathbf{51}_a$ therebetween.

Plate Cylinder Second End Part Lateral Adjustment

The plate cylinder second end part lateral adjustment $R_{32}$ includes a bearing carrier 61 rigidly encircling the plate cylinder second end part hollow shaft $\mathbf{3}_a$. An externally screw-threaded ring 62 is rotatably mounted on the plate cylinder second end part hollow shaft $\mathbf{3}_a$ via a bearing $\mathbf{61}_a$ on the bearing carrier 61. This threaded ring 62 is in mesh with the aforesaid internally threaded ring 205 which is shared by both plate cylinder second end part circumferential adjustment $R_{31}$ and lateral adjustment $R_{32}$. The threaded ring 62 is rigidly and concentrically attached to a driven gear 64 of annular shape. The driven gear 64 meshes with a drive pinion 66 via an intermediate gear 67. The drive pinion 66 is mounted to the output shaft of a bidirectional plate cylinder second end part lateral adjustment motor 65 which, as shown also in FIG. 2, is bracketed at 202 to the enclosure end wall 201 in side-by-side arrangement with the plate cylinder second end part circumferential adjustment motor 55. The intermediate gear 67 is rotatably mounted to the aforementioned cantilever shaft 207 on the second framing wall $F_2$.

The operation of the plate cylinder second end part lateral adjustment $R_{32}$ is such that the bidirectional rotation of the motor 65 will be imparted to the externally threaded ring 62 via the drive pinion 66, intermediate gear 67, and driven gear 64. Being in threaded engagement with the internally threaded ring 205, the externally threaded ring 62 will travel axially, causing simultaneous lateral displacement of the plate cylinder second end part 3 via the bearing $\mathbf{61}_a$, bearing carrier 61, and plate cylinder second end part hollow shaft $\mathbf{3}_a$.

The axial travel of the plate cylinder second end part hollow shaft $\mathbf{3}_a$ will not affect the second driven helical gear 30 by virtue of the straight-spline engagement therebetween. The plate cylinder second end part 3 will therefore travel only laterally. The driving torque of the second helical gear $HG_2$ will be applied to the plate cylinder second end part 3 via the third driven helical gear 30 in straight-spline engagement with the plate cylinder second end part hollow shaft $\mathbf{3}_a$, but not to the threaded ring 62 because of the presence of the bearing $\mathbf{61}_a$. Consequently, despite the provision of the plate cylinder second end part lateral adjustment $R_{32}$, the plate cylinder second end part 3 will be driven with its lateral position unchanged.

Operation

In the operation of the web-fed offset printing press having a plurality of printing units each constructed as hereinbefore described with reference to FIGS. 1–4, the cylinders of each printing unit are all driven synchronously from an electric drive motor, not shown. The motor rotation will be imparted to the blanket cylinder BC in each printing unit and thence to the plate cylinder PC via the driving helical gears $HG_1$ and $HG_2$ on the blanket cylinder trunnions and via the driven helical gears 10, 20 and 30 variously coupled to the plate cylinder. The three discrete parts 1–3 of the plate cylinder PC will jointly rotate with the blanket cylinder BC together with the unshown printing plates mounted respectively thereon.

In the course of such printing, the image being printed by either of the three parts 1–3 of the plate cylinder PC may be found to be out of register with the images printed by the other printing units. Then, with the printing unsuspended, any required part of the plate cylinder PC may be positionally readjusted either circumferentially by the associated one of the three circumferential adjustments $R_{11}$, $R_{21}$, and $R_{31}$, or laterally by the associated one of the three lateral adjustments $R_{12}$, $R_{22}$ and $R_{32}$, of that plate cylinder. The required plate cylinder part 1, 2 or 3 will travel only in the required circumferential or lateral direction relative to the other plate cylinder parts, until the image being printed by the printing plate on the plate cylinder part in question comes into register with the images being printed by the printing plates on the corresponding plate cylinder parts of the other printing units.

The plate cylinder center part 1 and first end part 2 are displaceable both circumferentially and laterally relative to each other, and so are the plate cylinder center part 1 and second end part 3. The plate cylinder first end part 2 and second end part 3 are also displaceable both circumferentially and laterally relative to each other via the plate cylinder center part 1. Consequently, the three parts 1–3 of the plate cylinder PC are each displaceable both circumferentially and laterally totally independently of the other plate cylinder parts.

Alternate Form

Figure 5:
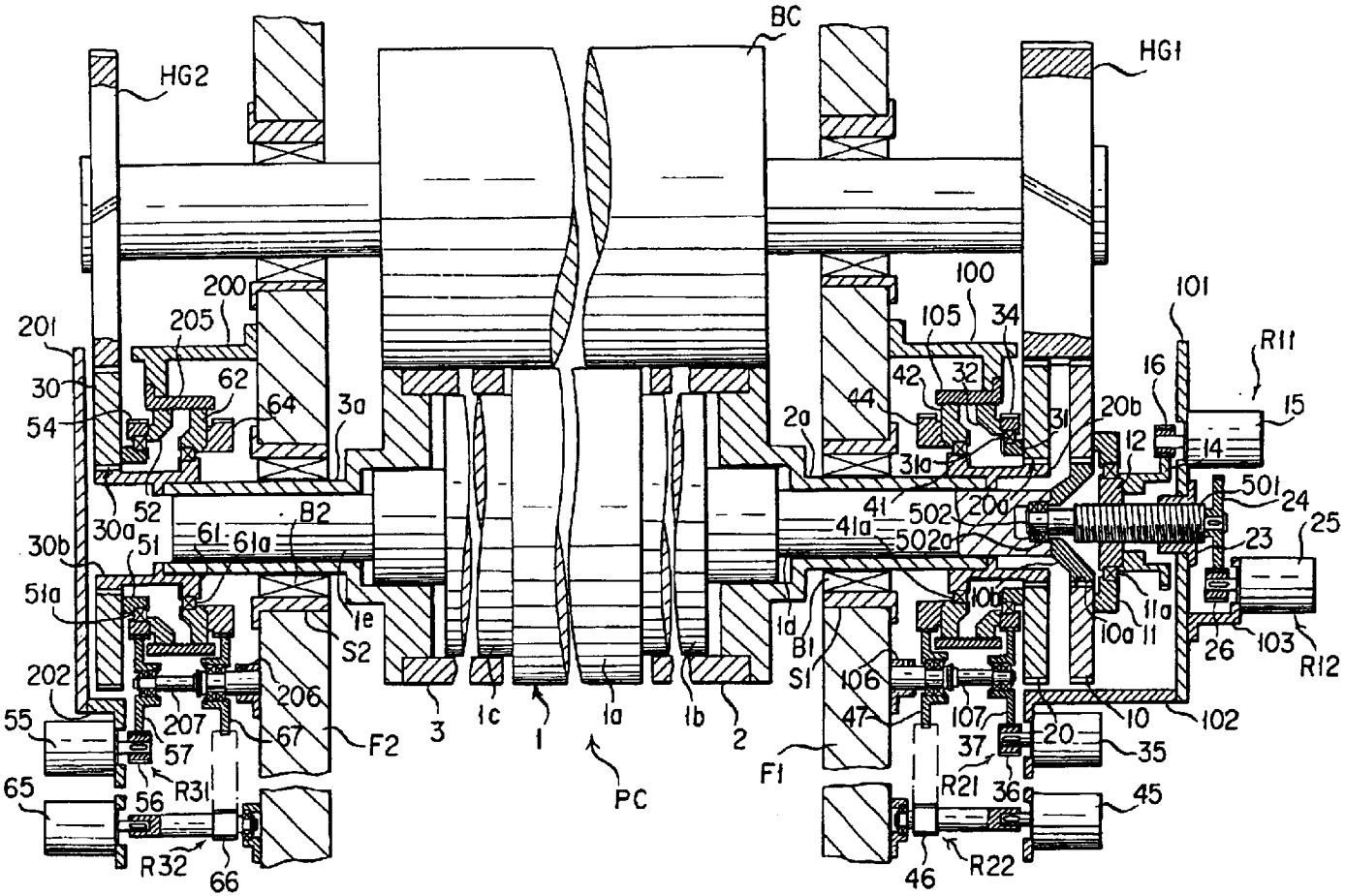
FIG. 5 is a view similar to FIG. 1 but showing an alternate embodiment of the invention.

FIG. 5 shows a second preferred form of three-part plate cylinder apparatus according to the invention. This second form is similar to its FIG. 1 counterpart in the construction of the three-part plate cylinder PC, of the circumferential and lateral adjustments $R_{21}$ and $R_{22}$ for the plate cylinder first or right-hand end part 2, and of the circumferential and lateral adjustments $R_{31}$ and $R_{32}$ for the plate cylinder second or left-hand end part 3. The difference resides in the fact that the circumferential adjustment $R_{11}$ and lateral adjustment $R_{12}$ for the plate cylinder center part 1 are both mounted outside the first or right-hand framing wall $F_1$.

Sticking outwardly of the plate cylinder first end part hollow shaft $\mathbf{2}_a$, the plate cylinder center part trunnion $\mathbf{1}_d$ is coupled via the first driven helical gear 10 to both plate cylinder center part circumferential adjustment $R_{11}$ and plate cylinder center part lateral adjustment $R_{12}$. The first driven helical gear 10 meshes with the first driving helical gear $HG_1$ and is further internally straight-splined at $\mathbf{10}_a$ to mesh with the externally straight-splined member $\mathbf{10}_b$ coaxially mounted fast to the projecting end of the plate cylinder center part first trunnion $\mathbf{1}_d$. The splined member $\mathbf{10}_b$ is shown to be funnel-shaped in this alternate embodiment. Thus the first driven helical gear 10 functions to transmit the rotation of the driving helical gear $HG_1$ to the plate cylinder center part first trunnion $\mathbf{1}_d$ while being free to travel axially relative to the latter.

The plate cylinder center part circumferential adjustment $R_{11}$ includes the bearing housing 11 coaxially affixed to the first driven helical gear 10 for carrying the bearing $\mathbf{11}_a$. Rotatably supported by the bearing $\mathbf{11}_a$ while being constrained to joint axial travel therewith, the internally threaded ring 12 is coaxially mounted on, and threadedly engaged with, an externally screw-threaded rod 501 which forms a part of both plate cylinder center part circumferential adjustment $R_{11}$ and plate cylinder center part lateral adjustment $R_{12}$. The threaded rod 501 is rotatably and coaxially coupled at its left-hand end to the plate cylinder center part trunnion $\mathbf{1}_d$ via a bearing $\mathbf{502}_a$ mounted to a bearing housing 502. The threaded rod 501 is therefore free to rotate relative to the plate cylinder center part trunnion $\mathbf{1}_d$ but is constrained to joint axial travel therewith. The right-hand end of the threaded rod 501 extends through, and is threadedly engaged with, an internally screw-threaded sleeve 23 which is mounted to the end wall 101 of the enclosure 100 on the first framing wall $F_1$ and which forms a part of the plate cylinder center part lateral adjustment $R_{12}$ yet to be detailed. Coaxially mounted fast to the internally threaded ring 12, the driven gear 14 meshes with the drive pinion 16 on the output shaft of the plate cylinder center part circumferential adjustment motor 15 mounted to the enclosure end wall 101.

Thus the bidirectional rotation of the plate cylinder center part circumferential adjustment motor 15 will be imparted to the internally threaded ring 12 via the intermeshing gears 14 and 16. Thereupon the internally threaded ring 12 will travel axially of the threaded rod 501 by virtue of its threaded engagement therewith. Being constrained to joint axial travel with the internally threaded ring 12 via the bearing housing 11 and bearing $\mathbf{11}_a$, the first driven helical gear 10 will travel axially and, by reason of its sliding engagement with the helical gear $HG_1$ on one of the blanket cylinder trunnions, circumferentially as well.

Although the first driven helical gear 10 will travel both axially and circumferentially as above, this axial motion will not be imparted to the plate cylinder center part first trunnion $\mathbf{1}_d$ because of the straight-spline engagement of the helical gear 10 with the member 10*b* on the trunnion $\mathbf{1}_d$. Only the rotation of the first driven helical gear 10 will be applied to the plate cylinder center part 1, causing the latter to be angularly displaced in either direction with its lateral position held unaltered. Incidentally, during printing, the driving torque of the first driving helical gear $HG_1$ will be transmitted to the plate cylinder center part 1 via the first driven helical gear 10 by virtue of the straight-spline engagement between these members 1 and 10, but not to the internally threaded ring 12 because of the interposition of the bearing $\mathbf{11}_a$ therebetween.

The plate cylinder center part first trunnion $\mathbf{1}_d$ is also coupled to the lateral adjustment $R_{12}$ for causing lateral displacement of the plate cylinder center part 1 in this alternate embodiment. The plate cylinder center part lateral adjustment $R_{12}$ includes an internally screw-threaded sleeve 23 which is mounted fast to the enclosure end wall 101 and which fits over the externally screw-threaded rod 501. This rod forms as aforesaid a part of both plate cylinder center part circumferential adjustment $R_{11}$ and plate cylinder center part lateral adjustment $R_{12}$. The threaded rod 22 has coaxially mounted on its end the driven gear 24 in mesh with the drive pinion 26 on the output shaft of the bidirectional plate cylinder center part lateral adjustment motor 25.

The bidirectional rotation of the plate cylinder center part lateral adjustment motor 25 will be imparted to the threaded rod 501 via the intermeshing gears 24 and 26. Thereupon the threaded rod 501 will undergo both angular and axial motion by virtue of its sliding engagement with the internally threaded sleeve 23. Since the threaded rod 501 is coupled to the plate cylinder center part first trunnion $\mathbf{1}_d$ via the bearing $\mathbf{502}_a$, only the axial travel of the threaded rod will be transmitted to the trunnion. Thus the plate cylinder center part 1 will adjustably travel laterally in either of two opposite directions.

Being loaded by the plate cylinder center part circumferential adjustment motor 15 via the gears 14 and 16, the internally threaded ring 12 will remain stationary in the face of the above combined angular and axial motion of the threaded rod 501. The axial travel of the plate cylinder center part first trunnion $\mathbf{1}_d$ will not be transmitted to the first driven helical gear 10, either, by virtue of the straight-spline engagement therebetween. Consequently, the plate cylinder center part 1 will undergo no angular displacement but only travel laterally. During printing, the plate cylinder center part 1 will rotate as the first driving helical gear $HG_1$ imparts its rotation to the first driven helical gear 10 in straight-spline engagement with the plate cylinder center part first trunnion $\mathbf{1}_d$. This rotation of the plate cylinder center part first trunnion $\mathbf{1}_d$ will not be transmitted to the threaded rod 501 because of the presence of the bearing $\mathbf{502}_a$ therebetween.

The operation of this FIG. 5 embodiment is considered self-evident from the foregoing operational description of the FIGS. 1–4 embodiment.

Notwithstanding the foregoing detailed disclosure it is not desired that the present invention be limited by the exact details of the illustrated embodiments or by the description thereof; instead, the invention should be construed broadly and in a manner consistent with the fair meaning or proper scope of the subjoined claims.

What is claimed is:

1. In a web-fed printing press having a series of printing units for printing images on a continuous web of paper or like material, a three-part plate cylinder apparatus included in each such printing unit and comprising:

(a) a pair of confronting framing means;

(b) a plate cylinder rotatably supported between the pair of framing means and split into three parts the three parts of the plate cylinder being capable of independent displacement both laterally and circumferentially for registration;

(c) drive means for jointly driving the three parts of the plate cylinder during printing;

(d) lateral adjustment means mounted outside the framing means and coupled to the three parts of the plate cylinder for causing lateral displacement of each part independently of the other parts;

(e) circumferential adjustment means mounted outside the framing means and coupled to the three parts of the plate cylinder for causing circumferential displacement of each part independently of the other parts; and (f) wherein the displacement of each plate cylinder part in either of the lateral and circumferential directions does not affect its position in the other direction.

2. The three-part plate cylinder apparatus of claim 1 wherein the lateral and the circumferential adjustment means for a center part of the three parts of the plate cylinder are mounted outside in separate framing means, respectively.

3. The three-part plate cylinder apparatus of claim 1 wherein each of the three parts of the plate cylinder has two newspaper pages width.

4. In a web-fed printing press having a series of printing units for printing images on a continuous web of paper or like material, a three-part plate cylinder apparatus included in each such printing unit and comprising:

(a) a first and a second spaced-apart framing means;

(b) a plate cylinder rotatably supported between the pair of framing means, the plate cylinder being divided into a center part and a first and a second end part which are slidably engaged with one another for independent lateral and circumferential displacement, the plate cylinder center part having a first and a second trunnion coaxially extending in opposite directions therefrom through the first and the second framing means, respectively, the plate cylinder first end part having a first hollow shaft coaxially extending therefrom through the first framing means and in sliding engagement with the first trunnion of the plate cylinder center part, the plate cylinder second end part having a second hollow shaft coaxially extending therefrom through the second framing means and in sliding engagement with the second trunnion of the plate cylinder center part;

(c) drive means coupled to one of the trunnions of the plate cylinder center part and to the first and the second hollow shaft of the plate cylinder first and second end parts for jointly driving the center part and first and second end parts of the plate cylinder during printing;

(d) plate cylinder center part circumferential adjustment means coupled to either of the first and the second trunnion of the plate cylinder center part on the outside of either of the first and the second framing means for causing circumferential displacement of the plate cylinder center part relative to the plate cylinder first and second end parts;

(e) plate cylinder center part lateral adjustment means coupled to either of the first and the second trunnion of the plate cylinder center part on the outside of either of the first and the second framing means for causing lateral displacement of the plate cylinder center part relative to the plate cylinder first and second end parts;

(f) plate cylinder first end part circumferential adjustment means coupled to the first hollow shaft on the outside of the first framing means for causing circumferential displacement of the plate cylinder first end part relative to the plate cylinder center part and second end part;

(g) plate cylinder first end part lateral adjustment means coupled to the first hollow shaft on the outside of the first framing means for causing lateral displacement of the plate cylinder first end part relative to the plate cylinder center part and second end part;

(h) plate cylinder second end part circumferential adjustment means coupled to the second hollow shaft on the outside of the second framing means for causing circumferential displacement of the plate cylinder second end part relative to the plate cylinder center part and first end part;

(i) plate cylinder second end part lateral adjustment means coupled to the second hollow shaft on the outside of the second framing means for causing lateral displacement of the plate cylinder second end part relative to the plate cylinder center part and first end part; and (j) wherein the displacement of each plate cylinder part in either of the lateral and circumferential directions does not affect its position in the other direction.

5. The three-part plate cylinder apparatus of claim 4 wherein the drive means comprises:

(a) a first and a second driving helical gear rotatably and coaxially mounted to the first and the second framing means, respectively;

(b) first, second and third straight spline means;

(c) a first driven helical gear meshing with the first driving helical gear and coaxially mounted to the first trunnion of the plate cylinder center part via the first straight spline means;

(d) a second driven helical gear meshing with the first driving helical gear and coaxially mounted to the first hollow shaft via the second straight spline means; and (e) a third driven helical gear meshing with the second driving helical gear and coaxially mounted to the second hollow shaft via the third straight spline means.

6. The three-part plate cylinder apparatus of claim 5 wherein the plate cylinder center part circumferential adjustment means comprises:

(a) a plate cylinder center part circumferential adjustment motor capable of bidirectional rotation; and (b) a drive linkage connected between the plate cylinder center part circumferential adjustment motor and the first driven helical gear in order to cause axial displacement of the latter in response to the rotation of the former, the axial displacement of the first driven helical gear being translated into circumferential displacement of the first trunnion of the plate cylinder center part via the first straight spline means by virtue of sliding engagement of the first driven helical gear with the first driving helical gear.

7. The three-part plate cylinder apparatus of claim 5 wherein the plate cylinder center part lateral adjustment means comprises:

(a) a plate cylinder center part lateral adjustment motor capable of bidirectional rotation; and (b) a drive linkage connected between the plate cylinder center part lateral adjustment motor and either of the first and the second trunnion of the plate cylinder center part in order to cause axial displacement of the latter in response to the rotation of the former.

8. The three-part plate cylinder apparatus of claim 5 wherein the plate cylinder first end part circumferential adjustment means comprises:

(a) a plate cylinder first end part circumferential adjustment motor capable of bidirectional rotation; and (b) a drive linkage connected between the plate cylinder first end part circumferential adjustment motor and the second driven helical gear in order to cause axial displacement of the latter in response to the rotation of the former, the axial displacement of the second driven helical gear being translated into circumferential displacement of the first hollow shaft, and hence of the plate cylinder first end part, via the second straight spline means by virtue of sliding engagement of the second driven helical gear with the first driving helical gear.

9. The three-part plate cylinder apparatus of claim 5 wherein the plate cylinder first end part lateral adjustment means comprises:

(a) a plate cylinder first end part lateral adjustment motor capable of bidirectional rotation; and (b) a drive linkage connected between the plate cylinder first end part lateral adjustment motor and the first hollow shaft in order to cause axial displacement of the latter, and hence lateral displacement of the plate cylinder first end part, in response to the rotation of the former.

10. The three-part plate cylinder apparatus of claim 5 wherein the plate cylinder second end part circumferential adjustment means comprises:

(a) a plate cylinder second end part circumferential adjustment motor capable of bidirectional rotation; and (b) a drive linkage connected between the plate cylinder second end part circumferential adjustment motor and the third driven helical gear in order to cause axial displacement of the latter in response to the rotation of the former, the axial displacement of the third driven helical gear being translated into circumferential displacement of the second hollow shaft, and hence of the plate cylinder second end part, via the third straight spline means by virtue of sliding engagement of the third driven helical gear with the second driving helical gear.

11. The three-part plate cylinder apparatus of claim 5 wherein the plate cylinder second end part lateral adjustment means comprises:

(a) a plate cylinder second end part lateral adjustment motor capable of bidirectional rotation; and (b) a drive linkage connected between the plate cylinder second end part lateral adjustment motor and the second hollow shaft in order to cause axial displacement of the latter, and hence lateral displacement of the plate cylinder second end part, in response to the rotation of the former.

* * * * *